US011401566B2

(12) United States Patent
Liu et al.

(10) Patent No.: US 11,401,566 B2
(45) Date of Patent: Aug. 2, 2022

(54) HIGH STRENGTH AND HIGH TOUGHNESS STAINLESS STEEL AND PROCESSING METHOD THEREOF

(71) Applicant: Zhejiang University, Hangzhou (CN)

(72) Inventors: Jiabin Liu, Hangzhou (CN); Hongtao Wang, Hangzhou (CN); Youtong Fang, Hangzhou (CN)

(73) Assignee: Zhejiang University, Hangzhou (CN)

( * ) Notice: Subject to any disclaimer, the term of this patent is extended or adjusted under 35 U.S.C. 154(b) by 600 days.

(21) Appl. No.: 15/778,001

(22) PCT Filed: Jun. 5, 2017

(86) PCT No.: PCT/CN2017/087156
§ 371 (c)(1),
(2) Date: Feb. 18, 2019

(87) PCT Pub. No.: WO2017/215478
PCT Pub. Date: Dec. 21, 2017

(65) Prior Publication Data

US 2019/0177809 A1 Jun. 13, 2019

(30) Foreign Application Priority Data

Jun. 17, 2016 (CN) ..... 201610437107.1

(51) Int. Cl.
*C21D 8/00* (2006.01)
*C21D 1/18* (2006.01)
(Continued)

(52) U.S. Cl.
CPC ..... *C21D 8/005* (2013.01); *C21D 1/18* (2013.01); *C21D 6/004* (2013.01); *C21D 8/0236* (2013.01);
(Continued)

(58) Field of Classification Search
None
See application file for complete search history.

(56) References Cited

U.S. PATENT DOCUMENTS 5,494,537 A * 2/1996 Miyakusu ..... B23D 61/028 148/325

FOREIGN PATENT DOCUMENTS

CN 101994066 A 3/2011
CN 102199734 A 9/2011
(Continued)

OTHER PUBLICATIONS

International Search Report issued in PCT/CN2017/087156 dated Sep. 18, 2017.
Written Opinion issued in PCT/CN2017/087156 dated Sep. 18, 2017.

*Primary Examiner* — Patricia L. Hailey
*Assistant Examiner* — Christopher D. Moody

(57) ABSTRACT

A stainless steel with high strength and high toughness and processing method thereof are disclosed in the present invention. The stainless steel comprising: C of 0.01%~0.1% weight percentage, N of 0.05%~0.2%, P of no higher than 0.03%, S of no higher than 0.003%, Si of 0.5%~1%, Mn of 1.0%~2.0%, Cr of 15%~17%, Ni of 5% to 7%, and Fe. The stainless steel contains austenite and strain-induced martensite structure, wherein the martensite is of irregular approximately spindle body shape, and the average size of its long axis ranges from 50 to 1000 nm and that of its short axis ranges from 20 to 500 nm, the volume percent of martensite in the stainless steel is 0.1% to 20%.

5 Claims, 3 Drawing Sheets

(51) Int. Cl.

| | |
|---|---|
| ***C22C 38/02*** | (2006.01) |
| ***C22C 38/04*** | (2006.01) |
| ***C22C 38/40*** | (2006.01) |
| ***C22C 38/58*** | (2006.01) |
| ***C21D 8/02*** | (2006.01) |
| ***C21D 6/00*** | (2006.01) |
| ***C22C 38/00*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/40* (2013.01); *C22C 38/58* (2013.01); *C21D 2211/001* (2013.01); *C21D 2211/008* (2013.01)

(56) References Cited

FOREIGN PATENT DOCUMENTS

| | | | |
|---|---|---|---|
| CN | 102251191 | A | 11/2011 |
| CN | 102994905 | A | 3/2013 |
| CN | 106011678 | A | 10/2016 |
| CN | 106167849 | A | 11/2016 |
| JP | 2000129401 | A | 5/2000 |

* cited by examiner

HIGH STRENGTH AND HIGH TOUGHNESS STAINLESS STEEL AND PROCESSING METHOD THEREOF

RELATED APPLICATIONS

This application is a 35 U.S.C. § 371 national phase application of PCT/CN2017/087156 (WO2017/215478), filed on Jun. 5, 2017 entitled " High Strength and High Toughness Stainless Steel and Processing Method Thereof", which application claims the benefit of Chinese Application Serial No. 201610437107.1, filed Jun. 17, 2016, which is incorporated herein by reference in its entirety.

FIELD OF THE INVENTION

The present invention relates to a stainless steel material with high strength and high toughness and processing method thereof, in particular, to a stainless steel with high yield strength and high elongation rate and its processing method.

BACKGROUND

Automobile industry is a pillar industry that influences the national economic development, technical progress and social modernization, which plays an important role. China clearly proposes that it is necessary to accelerate the development of the automobile industry which is closely related to steel and iron materials. Automobile manufacturing industry is the biggest user of sheet steel. To reduce fuel consumption and save energy, automobiles need to develop towards light weight; therefore higher and higher requirements are put forward for sheet steel used for automobiles.

FAW Audi A6, Shanghai Volkswagen B5, Shanghai General Motors Buick cars and some family cars adopt high strength galvanized steel sheets and laser tailor-welded blanks. Such steel sheets for public cars adopt Germany standards, including hot dip galvanizing, electrogalvanizing, high strength steel sheets, etc. The maximum width is 1800 mm and the maximum thickness is 4 mm; steel sheets for Fukang cars adopt French standards, with hot dip galvanizing as the main type; those for Xiali cars adopt Japanese standards, with hot dip galvanizing alloying as the main type; while steel for Jeep Cherokee adopts American standards which combines hot dip galvanizing and hot dip galvanizing alloying.

High strength hot rolled steel sheets are mostly used for parts which can bear a relatively great stress such as car frames, and longitudinal beams for different car types. The amount of such steel sheets used on trucks is big, approximately accounting for 60%-70% of the total amount of hot rolled steel sheets for trucks. Therefore both a relatively high strength and a good formability are required, and the highest strength of hot rolled steel sheets for general automobiles is 500 MPa. Although adding Nb, Ti and other micro-alloy elements can improve the strength, influences may be produced on the formability, thus limiting its application. To improve the strength level, dual-phase steel and TRIP steel are developed currently.

The feature of dual-phase steel (high strength steel) ferrite-martensite composite structure steel sheets is that about 15% hard phase is distributed on the fine ferritic matrix, and is further strengthened through solution atom. The production technology is as follows: stay for a period of time in the dual-phase area of ferrite and austenite when rolling steel sheets, then a large amount of phase ferrite is separated out, and the C concentration of the residual phase austenite increases, then using the rapid cooling method, the austenite structure is transformed into the martensite structure. Because steel mainly contains ferrite phase (about 80%~90%), so its percentage total elongation is relatively high, and due to the volume expansion when transforming into martensite from austenite, dislocation is formed in the surrounding area, thus reducing the yield strength and obtaining good formability. The tensile strength of the ferrite-martensite composite structure steel sheets ranges from 550 to 650 MPa, and the highest strength of the newly developed martensite composite structure hot rolled steel sheets is 780 MPa and the elongation rate is 21%.

Due to the restrictions of formability, dual-phase steel fails to reach the strength level of 800 MPa, so in order to meet the demand for a higher strength and solve the contradiction between strength and plasticity, the transformation induced plasticity steel (TRIP steel for short) is developed, which comes on stage as the star of hope of high extensibility and high strength steel sheets. The main component of TRIP steel is C—Mn—Si alloy system, and the composition characteristics are low carbon, low alloying and pure steel quality. In terms of its production technology, a technology for heating processing of critical annealing in the dual-phase area and heat preservation in the bainite transformation area is adopted when hot rolling. There is a three-phase structure including ferrite, bainite and about 10% retained austenite. When the hot-rolled steel sheet with 10% retained austenite is processed, the retained austenite will be transformed into martensite structure gradually. Due to hardening, the local deformation is overcome and the percentage total elongation is improved. High strength comes from the common contribution of martensite, bainite and alloying element solution strengthening. The change range of the performance of TRIP steel is as follows: yield strength 340 MPa~860 MPa, tensile strength 610 MPa10~80 MPa and elongation rate 22%~37%.

As lightweight of automobiles and safety performance requirements are further improved, higher requirements for the strength and the toughness of high strength steel for automobiles, especially steel for bumpers, are put forward. Generally, it is required that steel sheets shall have a yield strength of above 1000 MPa and a elongation rate of no less than 30%. The above dual-phase steel and TRIP steel fail to reach such a high performance level, therefore it is urgently necessary to develop new type advanced steel with high strength and high toughness.

SUMMARY

The object of the present invention is to provide stainless steel with high strength and high toughness and its processing method so as to solve the contradiction between the inherent strength and plasticity of the processing technology of traditional materials.

To solve the above technical problem, the inventor has conducted various researches, finding that the organizational and processing conditions shall also be defined in 3XX series stainless steel in addition to stipulating the basic components of the base material. Dispersedly distributed nanometer martensite and martensite inactivation effect caused by interface element segregation are utilized to achieve the combination property of high strength and high toughness.

The technical solutions adopted in the present invention are as follows:

The present invention provides a stainless steel, including the following features:

(1) The stainless steel contains C of 0.01%~0.1% weight percentage, N of 0.05%~0.2%, P of no higher than 0.03%, S of no higher than 0.003%, Si of 0.5%~1%, Mn of 1.0%~2.0%, Cr of 15%~17%, Ni of 5%~7%, and Fe; among chemical constituents, P and S are impurities;

(2) The stainless steel contains austenite and strain-induced martensite structure, of which martensite is of irregular approximately spindle body shape, and the average size of its long axis ranges from 50 to 1000 nm and that of its short axis ranges from 20 to 500 nm. The volume percent of martensite in the stainless steel is 0.1%~20%; there is an element segregation layer on the interface between martensite and austenite, the thickness of which is 1~20 nm and inside which the contents of Ni, Mn, N and Si elements are respectively 1.2~3 times of the average content of each element in the stainless steel.

The present invention provides a processing method of the stainless steel, including the following steps:

(a) Perform solution treatment on the raw material whose element composition meets the requirements, and cool down to obtain the sample; the element composition of the raw material is as follows: by weight percentage, 0.01%~0.1% C, 0.05%~0.2% N, no higher than 0.03% P, no higher than 0.003% S, 0.5%~1% Si, 1.0%~2.0% Mn, 15%~17% Cr, 5%~7% Ni, and Fe;

(b) Deform the sample at room temperature to a certain extent, during which multi-pass small deformation is adopted to gradually increase the deformation amount. The increment of percentage reduction of area of each pass is 0.01~0.1, and the accumulative total reduction of area shall conform to formula (1)

$$1-\exp\{-\beta[1-\exp(-\alpha\varepsilon)]^n\}<0.3 \quad (1)$$

$\varepsilon$ is the reduction of area, $\alpha$ is a parameter related to the stacking fault energy (SFE), which can be obtained by consulting the corresponding data of related SFE to $\alpha$, $\beta$ is a parameter related to the martensite phase transformation chemical driving energy of the sample material, which can be obtained by consulting the corresponding data of chemical driving energy to $\beta$, n is the pre-exponential factor, which is generally taken as 2;

(c) Perform annealing treatment on the sample treated through step (b) at 50~550° C. for 10 min~100 h, and cool down to obtain the stainless steel.

In step (a), to obtain high strength and expand the Austenite area, C and N elements are added to the raw material, but when C content exceeds 0.1% or N content exceeds 0.2%, Cr carbide will be separated out on the crystal boundary, and reduce the plasticity of rolled steel, therefore the upper limits of their contents are defined as 0.1% and 0.2% respectively. In order to make the stainless steel have the strain-induced martensite effect at room temperature, Cr and Ni elements are added to the raw material, but if too many Cr and Ni elements are added, the stacking fault energy of the material will be too high and the martensite phase transformation may be unable to occur at room temperature, while if too little, the material may change to martensite too early in the cooling process, therefore Cr and Ni contents are defined as 15%~17% and 5%~7% respectively.

Further, in step (a), the temperature of solution treatment is 1050° C.~1150° C., the holding time is 1 min~2 h, and the cooling mode is water quenching or oil quenching.

To obtain high strength, the strain-induced martensite effect mentioned above is utilized in the present invention, and in step (b), machining deformation is conducted on the sample to a certain extent at room temperature so as to transform some austenite into martensite. If the martensite content is too low, then the strengthening effect will not be obvious, but if it is too high, the plasticity will be damaged seriously, therefore the content is controlled within the range of 1%~20%. To effectively develop the strengthening effect of martensite, through multi-pass small deformation, let the produced strain-induced martensite to be of irregular approximately spindle body shape, and the average size of its long axis ranges from 50 to 1000 nm and that of its short axis ranges from 20 to 500 nm. Further, in step (b), the deformation modes are rolling, stamping, forging or drawing. Both the stacking fault energy and the phase transformation driving energy are determined by the chemical components of the material. When the chemical components are determined, the corresponding stacking fault energy and phase transformation driving energy can also be determined. The former can be calculated through formula (2):

$$SFE=-53+6.2(\%\ Ni)+0.7(\%\ Cr)+3.2(\%\ Mn)+9.3(\%\ Mo) \quad (2)$$

Where, % Ni, % Cr, % Mn and % Mo respectively represent the weight percentage of these elements in the stainless steel.

In step (c) of the present invention, to further improve the yield strength without reducing the plasticity, perform long-time low temperature annealing on the sample after multi-pass small deformation in step (b). Because Ni, Mn, Si and N are austenite widening elements, so their energy in martensite is higher than that in austenite, thus they tend to diffuse from martensite to austenite. Let the above elements to diffuse and gather and produce an interface segregation area on the interface between martensite and austenite through annealing at 50~550° C. for 10 min~100 h in the present invention. Due to the segregation area, martensite will be surrounded and constrained by a layer of more table austenite, and unable to continue to grow up in the subsequent deformation and thus become inactivated. Consequently, martensite nucleation must be induced to grow up through dislocation movement and piling up again in the deformation process of the sample. Further, in step (c), the heating mode is heating up with the furnace, and the cooling mode is cooling with the furnace or air cooling.

The processing method of the preferable stainless steel in the present invention comprises steps (a) to (c).

The advantageous effect of the present invention is that the yield strength of the stainless steel prepared through deformation at room temperature reaches over 600 MPa and its elongation rate reaches 30%; and through subsequent annealing, the yield strength of the sample is increased to over 1000 MPa and its elongation rate remains at over 30%. So, the stainless steel prepared in the present invention not only has high strength and high toughness, but also avoids the contradiction between the inherent strength and plasticity of materials in traditional processing technologies.

DETAILED DESCRIPTION

Figure 1:
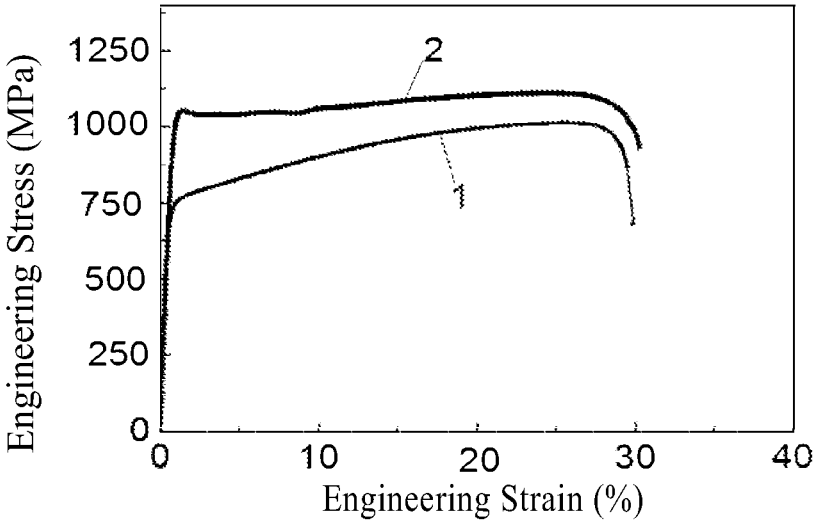
FIG. 1 is an engineering stress-strain curve of Example 1 in the present invention, 1 is the sample obtained through machining deformation at room temperature; and 2 is the sample obtained through long-time low temperature annealing after machining at room temperature.
Figure 2:
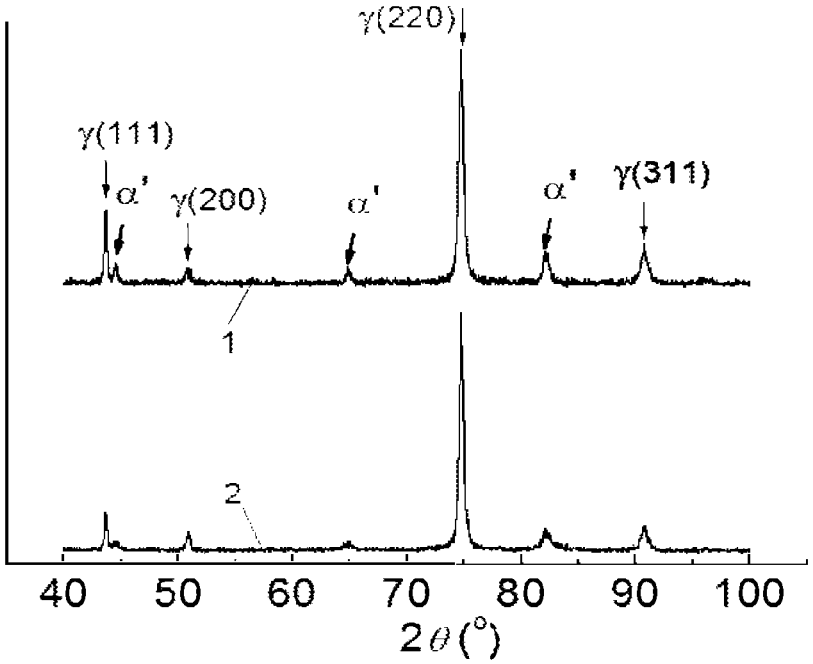
FIG. 2 is an X-ray spectrum line of the present invention, 1 is the sample obtained through machining deformation at room temperature in Example 1, and 2 is the sample obtained through machining deformation at room temperature in Example 17.
Figure 3:
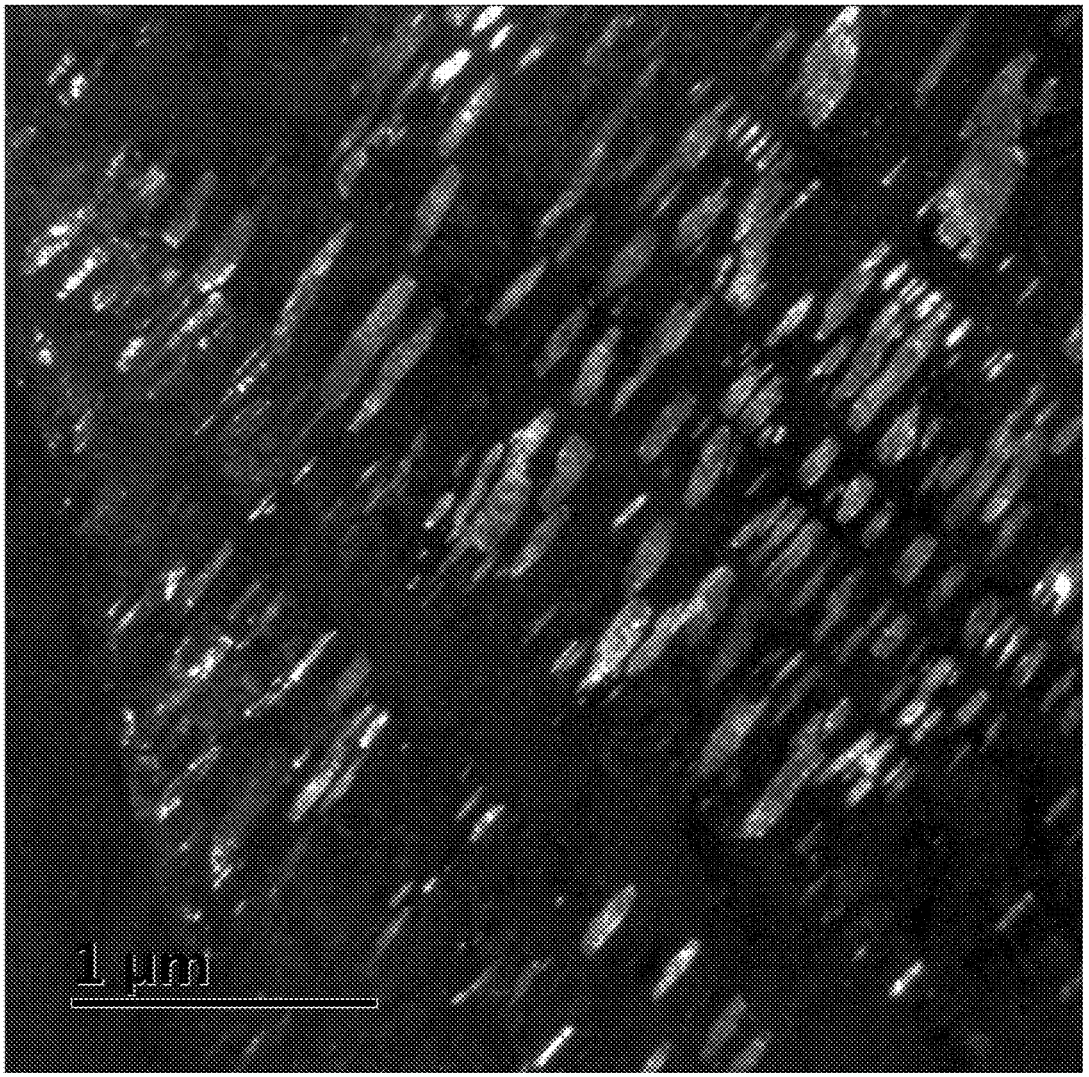
FIG. 3 is a photograph of the dark field of the transmission electron microscope center of the sample obtained through machining deformation at room temperature in Example 3, on which the white bright area is martensite.
Figure 4A:
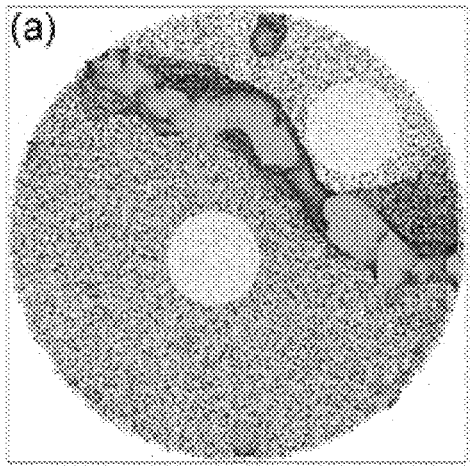
FIG. 4*a* is a distribution diagram of interface element segregation area of the three-dimensional atom probe result of the sample obtained through deformation at room temperature and low temperature heat treatment in Example 1 of the present invention.
Figure 4B:
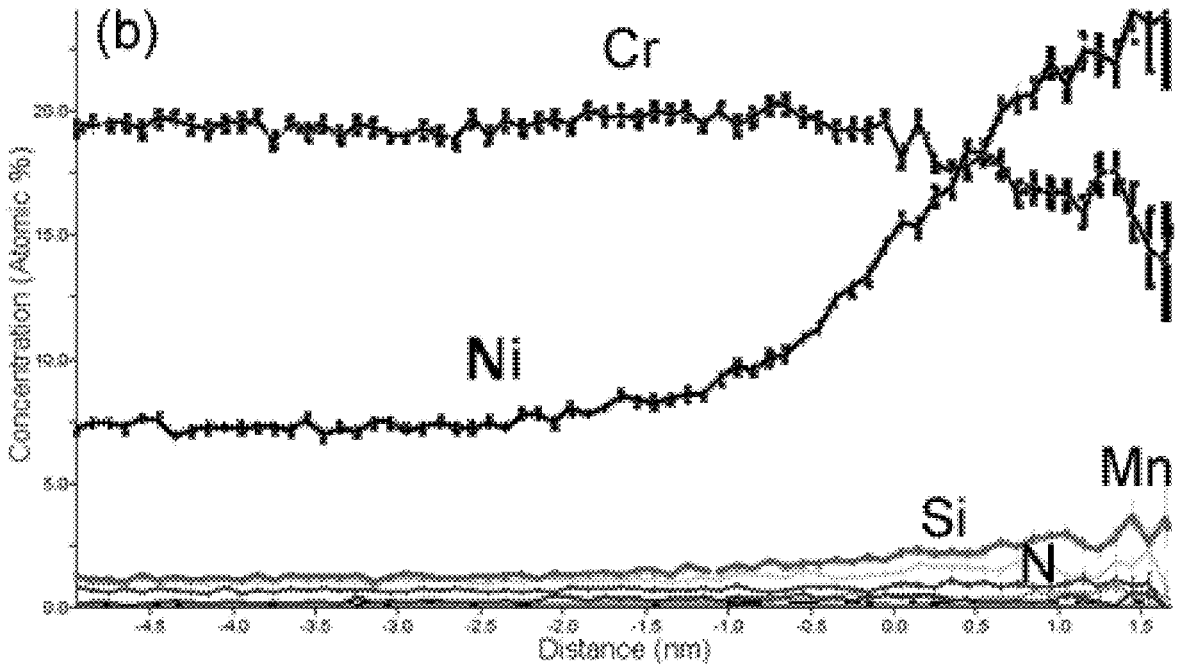
FIG. 4*b* is a distribution curve of the matrix of the three-dimensional atom probe result of the sample obtained through deformation at room temperature and low temperature heat treatment in Example 1 of the present invention and Cr, Ni, Mn, Si and N elements on the interface.

The technical solutions of the present invention will be further described with specific embodiments below, but the protection scope of the present invention is not limited thereto:

Example 1

For steel containing 0.01% C, 0.2% N, 0.03% P, 0.003% S, 0.5% Si, 1.0% Mn, 15% Cr, 5% Ni, and Fe, perform water quenching after heat preservation at 1050° C. for 2 h. Perform multi-pass rolling deformation on the obtained sample at room temperature, with the rolling deformation amount per pass being 0.05 and the accumulative total deformation amount being 0.2. Later, put the obtained sample at 450° C. for heat preservation for 24 h and cool it in the air. Observe the shape and size of the martensite inside the sample using a transmission electron microscope, and measure the content of martensite of the sample using X-ray diffraction. Perform the tensile test according to GB/T 228.1-2010 *Metallic materials—Tensile testing—Part 1: Method of test at room temperature*, to test the yield strength and the elongation rate of the sample. Test the constituents around the martensite in the sample using a three-dimensional atom probe.

Example 2

The compositions of material used include 0.1% C, 0.2% N, 0.03% P, 0.003% S, 0.5% Si, 1.0% Mn, 15% Cr, 5% Ni, and Fe. Other procedures are the same as those in Example 1.

Example 3

The compositions of material used include 0.1% C, 0.05% N, 0.03% P, 0.003% S, 0.5% Si, 1.0% Mn, 15% Cr, 5% Ni, and Fe. Other procedures are the same as those in Example 1.

Example 4

The compositions of material used include 0.05% C, 0.1% N, 0.02% P, 0.001% S, 0.5% Si, 1.0% Mn, 15% Cr, 5% Ni, and Fe. Other procedures are the same as those in Example 1.

Example 5

The compositions of material used include 0.05% C, 0.15% N, 0.02% P, 0.001% S, 1% Si, 2.0% Mn, 15% Cr, 5% Ni, and Fe. Other procedures are the same as those in Example 1.

Example 6

The compositions of material used include 0.05% C, 0.15% N, 0.02% P, 0.001% S, 0.5% Si, 1.0% Mn, 17% Cr, 5% Ni, and Fe. Other procedures are the same as those in Example 1.

Example 7

The compositions of material used include 0.05% C, 0.15% N, 0.02% P, 0.001% S, 0.5% Si, 1.0% Mn, 15% Cr, 7% Ni, and Fe. Other procedures are the same as those in Example 1.

Example 8

The compositions of material used include 0.05% C, 0.15% N, 0.01% P, 0.001% S, 0.8% Si, 1.5% Mn, 16% Cr, 6% Ni, and Fe. Other procedures are the same as those in Example 1.

Example 9

The temperature of solution treatment is 1150° C. and the holding time is 1 min, the cooling mode is water quenching. Other procedures are the same as those in Example 1.

Example 10

The temperature of solution treatment is 1100° C. and the holding time is 30 min, the cooling mode is oil quenching. Other procedures are the same as those in Example 1.

Example 11

The room-temperature deformation mode is stamping rather than rolling. Other procedures are the same as those in Example 1.

Example 12

The room-temperature deformation mode is forging rather than rolling. Other procedures are the same as those in Example 1.

Example 13

The room-temperature deformation mode is drawing rather than rolling. Other procedures are the same as those in Example 1.

Example 14

The rolling deformation amount per pass at room temperature is 0.01. Other procedures are the same as those in Example 1.

Example 15

The rolling deformation amount per pass at room temperature is 0.1, and the accumulative total deformation amount is 0.3. Other procedures are the same as those in Example 1.

Example 16

The rolling deformation amount per pass at room temperature is 0.15. Other procedures are the same as those in Example 1.

Example 17

The rolling deformation amount per pass at room temperature is 0.01, and the accumulative total deformation amount is 0.1. Other procedures are the same as those in Example 1.

Example 18

The annealing process after the rolling at room temperature is to anneal 10 min at 550° C. Other procedures are the same as those in Example 1.

Example 19

The annealing process after the rolling at room temperature is to anneal 100 h at 50° C. Other procedures are the same as those in Example 1.

Example 20

The annealing process after the rolling at room temperature is to anneal 50 h at 150° C. Other procedures are the same as those in Example 1.

Comparative Example 1

The compositions of material used include 0.2% C, 0.25% N, 0.03% P, 0.003% S, 0.5% Si, 1.0% Mn, 15% Cr, 5% Ni, and Fe. Other procedures are the same as those in Example 1.

Comparative Example 2

The compositions of material used include 0.05% C, 0.1% N, 0.03% P, 0.003% S, 0.5% Si, 1.0% Mn, 20% Cr, 5% Ni, and Fe. Other procedures are the same as those in Example 1.

Comparative Example 3

The compositions of material used include 0.05% C, 0.1% N, 0.03% P, 0.003% S, 0.5% Si, 1.0% Mn, 17% Cr, 9% Ni, and Fe. Other procedures are the same as those in Example 1.

Comparative Example 4

The compositions of material used include 0.05% C, 0.1% N, 0.03% P, 0.003% S, 0.5% Si, 1.0% Mn, 13% Cr, 5% Ni, and Fe. Other procedures are the same as those in Example 1.

Comparative Example 5

The compositions of material used include 0.05% C, 0.1% N, 0.03% P, 0.003% S, 0.5% Si, 1.0% Mn, 17% Cr, 3% Ni, and Fe. Other procedures are the same as those in Example 1.

Comparative Example 6

The rolling deformation amount per pass at room temperature is 0.2. Other procedures are the same as those in Example 1.

Comparative Example 7

The accumulative total deformation amount at room temperature is 0.5. Other procedures are the same as those in Example 1.

Comparative Example 8

The annealing process after the rolling at room temperature is to anneal 24 h at 650° C. Other procedures are the same as those in Example 1.

Comparative Example 9

The annealing process after the rolling at room temperature is to anneal 5 min at 250° C. Other procedures are the same as those in Example 1. Results in the above examples are shown in Table 1 and Table 2.

TABLE 1

The contents and sizes of the martensites of the samples obtained after long-term low-temperature annealing in the above examples

| | Shape | Content (volume fraction, %) | Average size of long axis (nm) | Average size of short axis (nm) | Remark |
|---|---|---|---|---|---|
| Example 1 | Approximately spindle body | 5 | 500 | 100 | |
| Example 2 | Approximately spindle body | 4.8 | 520 | 90 | |
| Example 3 | Approximately spindle body | 5.1 | 550 | 85 | |
| Example 4 | Approximately spindle body | 5.5 | 490 | 105 | |
| Example 5 | Approximately spindle body | 4.2 | 480 | 100 | |
| Example 6 | Approximately spindle body | 5.7 | 835 | 220 | |
| Example 7 | Approximately spindle body | 4 | 475 | 95 | |
| Example 8 | Approximately spindle body | 6 | 550 | 110 | |
| Example 9 | Approximately spindle body | 5.1 | 510 | 105 | |
| Example 10 | Approximately spindle body | 5.2 | 520 | 110 | |
| Example 11 | Approximately spindle body | 6 | 720 | 330 | |
| Example 12 | Approximately spindle body | 5.3 | 505 | 105 | |
| Example 13 | Approximately spindle body | 5.9 | 490 | 95 | |
| Example 14 | Approximately spindle body | 4.8 | 450 | 85 | |
| Example 15 | Approximately spindle body | 20 | 1000 | 500 | |
| Example 16 | Approximately spindle body | 3 | 400 | 80 | |

TABLE 1-continued

The contents and sizes of the martensites of the samples obtained after long-term low-temperature annealing in the above examples

| | Shape | Content (volume fraction, %) | Average size of long axis (nm) | Average size of short axis (nm) | Remark |
|---|---|---|---|---|---|
| Example 17 | Approximately spindle body | 1 | 50 | 20 | |
| Example 18 | Approximately spindle body | 5 | 500 | 100 | |
| Example 19 | Approximately spindle body | 5 | 500 | 100 | |
| Example 20 | Approximately spindle body | 5 | 500 | 100 | |
| Comparative Example 1 | Massive | 50 | / | / | More Cr compounds |
| Comparative Example 2 | Massive | 35 | / | / | |
| Comparative Example 3 | / | 0 | / | / | No martensite |
| Comparative Example 4 | / | 0 | / | / | No martensite |
| Comparative Example 5 | Massive | 100 | / | / | |
| Comparative Example 6 | Approximately spindle body + Massive | 25 | 2000 | 1000 | |
| Comparative Example 7 | Massive | 75 | / | / | |
| Comparative Example 8 | / | 0 | / | / | No martensite, more Cr compounds |
| Comparative Example 9 | Approximately spindle body | 5 | 500 | 100 | |

TABLE 2

Yield strengths and elongation rates of samples obtained by room-temperature deformation and long-term low temperature annealing in the above examples

| | Samples obtained by room-temperature deformation | | Samples obtained by low temperature annealing | |
|---|---|---|---|---|
| | Yield strength (MPa) | Elongation rate (%) | Yield strength (MPa) | Elongation rate (%) |
| Example 1 | 600 | 30 | 1000 | 30 |
| Example 2 | 610 | 30 | 1015 | 31 |
| Example 3 | 605 | 31 | 1000 | 30 |
| Example 4 | 615 | 29 | 1020 | 30 |
| Example 5 | 600 | 31 | 1010 | 31 |
| Example 6 | 590 | 32 | 1000 | 32 |
| Example 7 | 595 | 31 | 1000 | 31 |
| Example 8 | 600 | 31 | 1020 | 31 |
| Example 9 | 620 | 30 | 1050 | 31 |
| Example 10 | 610 | 31 | 1030 | 31 |
| Example 11 | 630 | 30 | 1050 | 30 |
| Example 12 | 620 | 31 | 1040 | 31 |
| Example 13 | 605 | 32 | 1020 | 32 |
| Example 14 | 620 | 34 | 1060 | 34 |
| Example 15 | 630 | 30 | 1050 | 30 |
| Example 16 | 590 | 32 | 1000 | 32 |
| Example 17 | 580 | 35 | 1000 | 35 |
| Example 18 | 600 | 30 | 1000 | 35 |
| Example 19 | 600 | 30 | 1060 | 30 |
| Example 20 | 600 | 30 | 1040 | 32 |

TABLE 2-continued

Yield strengths and elongation rates of samples obtained by room-temperature deformation and long-term low temperature annealing in the above examples

| | Samples obtained by room-temperature deformation | | Samples obtained by low temperature annealing | |
|---|---|---|---|---|
| | Yield strength (MPa) | Elongation rate (%) | Yield strength (MPa) | Elongation rate (%) |
| Comparative Example 1 | 800 | 12 | 1250 | 5 |
| Comparative Example 2 | 950 | 3 | 900 | 5 |
| Comparative Example 3 | 460 | 43 | 500 | 45 |
| Comparative Example 4 | 550 | 34 | 600 | 32 |
| Comparative Example 5 | 890 | 21 | 800 | 22 |
| Comparative Example 6 | 700 | 25 | 850 | 20 |
| Comparative Example 7 | 900 | 5 | 950 | 7 |
| Comparative Example 8 | 600 | 30 | 450 | 60 |
| Comparative Example 9 | 600 | 30 | 600 | 30 |

TABLE 3

Contents of elements of the samples obtained by long-term low temperature annealing in the above examples that are measured by three-dimensional atom probe testing

| Area | Element | Example 1 | Example 13 | Example 18 | Comparative Example 9 |
|---|---|---|---|---|---|
| Average overall molar content of sample (%) | Ni | 5 | 5 | 5 | 5 |
| | Mn | 1 | 1 | 1 | 1 |
| | N | 0.2 | 0.2 | 0.2 | 0.2 |
| | Si | 0.5 | 0.5 | 0.5 | 0.5 |
| Partial molar content of segregation area (%) | Ni | 15 | 13 | 6 | 5 |
| | Mn | 2.9 | 2.4 | 1.2 | 1 |
| | N | 0.5 | 0.5 | 0.24 | 0.2 |
| | Si | 1.5 | 1.3 | 0.6 | 0.5 |
| Thickness of segregation area (nm) | | 20 | 15 | 1 | / |

Results analysis is as follows:

Examples 1 to 8 are to investigate the effects of compositions on the martensite shape, content and size. In Examples 1 to 8, spindle martensites are obtained, with the content from 1% to 20%, and long axis at 100~1000 nm, short axis at 20~500 nm. In Comparative Example 1, a large amount of Cr compounds are generate due to high contents of C and N; in Comparative Example 2, due to excessively high content of Cr, the ferrite region is expanded, resulting in too small austenite region, and the martensite content is high and they are mutually connected to form a massive martensite; in Comparative Example 3, due to high content of Ni, the austenite region is expanded significantly and the austenite is too stable to produce strains to induce martensitic effect during the room-temperature processing and deformation stage, and there is no martensite in the structure; in Comparative Example 4, as Cr content is too low, which is equivalent to too high content of Ni, the austenite is too stable to produce strains to induce martensitic effect during the room-temperature processing and deformation stage, and there is no martensite in the structure; In Comparative Example 5, due to too low content of Ni, the austenite is too unstable and completely transformed to martensite structure in the solution-cooling process; the above results show that only if the material compositions meet the range disclosed in the present invention can a reasonable martensite content and size be obtained.

Examples 1, 9 and 10 are to investigate the effects of solution treatment on the material microstructure and properties. Regardless of water quenching or oil quenching, ideal martensite microstructure in shape, content and size can be obtained within the holding temperature and time specified in the present invention, and excellent mechanical properties of significantly increased strength without decrease in elongation rate will be exhibited after low-temperature heat treatment.

Examples 1, 11 to 13 are to investigate the effect of room-temperature deformation modes on material microstructure and properties. Regardless of rolling, extrusion, forging or drawing, ideal martensite microstructure in shape, content and size can be obtained, and excellent mechanical properties of significantly increased strength without decrease in elongation rate will be exhibited after low-temperature heat treatment.

Examples 1, 14 to 17 are to investigate the effect of room-temperature deformation amount per pass and accumulative total deformation amount on the material microstructure and properties. As long as within the range of deformation amount per pass and accumulative total deformation amount defined in the invention, will ideal martensite microstructure in shape, content and size be obtained, and excellent mechanical properties of significantly increased strength without decrease in elongation rate will be exhibited after low-temperature heat treatment. As shown from Example 1 and Example 14, the smaller the amount of deformation per pass, the smaller the size of the martensite obtained, and the more obvious the strengthening effect. When the amount of deformation per pass is beyond the defined range, e.g. in Comparative Example 6, the effect of significant increase in strength without reduction in elongation rate after low-temperature treatment will not be achieved. As shown from Example 1 and Example 15, the larger the deformation amount within the defined range, the higher the martensite content, and the more obvious the strengthening effect, to maintain no reduction in elongation rate after low-temperature annealing. When the cumulative deformation amount exceeds the limit, for example, in Comparative Example 7, although the content of martensite is high with obvious strengthening effect, the elongation rate is very low, unable to meet the goal of high strength and high toughness.

Examples 1, 18 to 20 are to investigate the effects of annealing temperature and time after room-temperature deformation on the material microstructure and properties. As long as within the range of the annealing temperature and time defined in the invention, will ideal martensite microstructure in shape, content and size be obtained, and excellent mechanical properties of significantly increased strength without decrease in elongation rate will be exhibited after low-temperature heat treatment. If the annealing temperature is beyond the defined range, for example, in Comparative Example 8, martensite will be reverse-phase turned back to austenite and Cr compounds will be produced, which will seriously deteriorate the material properties. If the annealing time is too short, for example, in Comparative Example 9, the alloying elements have not diffused and enriched yet. As shown in Table 3, no obvious segregation layer has been generated, unable to achieve the effect of a significant increase in strength without reduction in elongation rate.

What is claimed is:

1. A stainless steel, comprising:

(1) the stainless steel contains the following elements: by weight percentage, 0.01%~0.1% C, 0.05%~0.2% N, no higher than 0.03% P, no higher than 0.003% S, 0.5%~1% Si, 1.0%~2.0% Mn, 15%~17% Cr, 5%~7% Ni, and Fe;

(2) the stainless steel contains austenite and 0.1%~20% strain-induced martensite in volume percentage, wherein there is an element segregation layer on an interface between the strain-induced martensite and the austenite, and the element segregation layer has a thickness of 1~20 nm and inside the element segregation layer, the contents of Ni, Mn, N and Si are respectively 1.2~3 times of an average content of each element in the stainless steel.

2. A processing method of the stainless steel according to claim 1, comprising:

(a) conducting a solution treatment on a raw material, and cooling down to obtain a sample, wherein the element composition of the raw material is as follows: by weight percentage, 0.01%~0.1% C, 0.05%~0.2% N, no higher than 0.03% P, no higher than 0.003% S, 0.5%~1% Si, 1.0%~2.0% Mn, 15%~17% Cr, 5%~7% Ni, and Fe;

(b) performing a multi-pass deformation on the sample obtained in step (a) at a room temperature, with a deformation amount per pass being 0.01-0.1 and an accumulative total deformation amount being 0.2-0.3 and (c) conducting an annealing treatment on the sample treated through step (b) at 50~550° C. for 10 min~100 h, and cool down to obtain the stainless steel.

3. The processing method of stainless steel according to claim 2, wherein in step (a), the solution treatment is performed at a temperature of 1050° C.~1150° C. and a holding time of 1 min-2 h.

4. The processing method of stainless steel according to claim 2, wherein the cooling in step (a) is water quenching or oil quenching.

5. The processing method of stainless steel according to claim 2, wherein the deformation in step (b) is rolling, stamping, forging or drawing.

* * * * *